United States Patent [19]

Shigeta

[11] Patent Number: 4,519,887

[45] Date of Patent: May 28, 1985

[54] APPARATUS FOR AUTOMATICALLY ATTACHING AND DETACHING CASSETTE-TYPE ROLLS

[75] Inventor: Tatsuo Shigeta, Nagareyama, Japan

[73] Assignee: Think Laboratory Co., Ltd., Chiba, Japan

[21] Appl. No.: 503,841

[22] Filed: Jun. 13, 1983

[51] Int. Cl.[3] ..... C25D 17/06

[52] U.S. Cl. ..... 204/212

[58] Field of Search ..... 204/212, 215, 216

[56] References Cited

U.S. PATENT DOCUMENTS

| | | | |
|---|---|---|---|
| 3,462,357 | 8/1969 | Karlquist | 204/212 |
| 3,660,265 | 5/1972 | Kangas | 204/25 |
| 3,664,944 | 5/1972 | Buckley | 204/212 |
| 4,340,450 | 7/1982 | Saito | 204/215 |

*Primary Examiner*—Thomas Tufariello

*Attorney, Agent, or Firm*—Koda and Androlia

[57] ABSTRACT

The invention is concerned with an apparatus for automatically attaching and detaching cassette-type rolls, which is suited for plating peripheral surfaces of the roll having shaft, and particularly for plating peripheral surfaces of a photogravure roll, with copper or chromium. The conventional apparatus which horizontally chucks both ends of a photogravure roll and which also spins the roll, could be adapted to the cassette-type hollow rolls, but could not be adapted to the cassette-type rolls having shaft. According to the apparatus for attaching and detaching cassette-type rolls of the present invention, the current-carrying supporters are exchanged depending upon the type of the roll to be treated, and the leak-proof caps are made up of moving caps that slide on the outer side of the spindles and exchange caps that are located between end surfaces of the roll and the moving caps. By suitably selecting and exchanging the current-carrying supporters and exchange caps, the apparatus can be adapted to different types of rolls having shaft. That is, the roll R with shaft is placed on the attaching/detaching plate, current-carrying supporters 4, 5 are fitted to the shaft portions, exchange caps 6*b*, 7*b* are fitted to the supporters 4,5, and the apparatus is placed on the roll to chuck it by spindles 2, 3. When the roll R with shaft of a different type is to be treated, another current-carrying supporters 4, 5 and exchange caps 6*b*, 7*b* are used, which are suited for it.

1 Claim, 3 Drawing Figures

APPARATUS FOR AUTOMATICALLY ATTACHING AND DETACHING CASSETTE-TYPE ROLLS

BACKGROUND OF THE INVENTION

1. Field of the Invention

The present invention relates to an apparatus for automatically attaching and detaching cassette-type rolls, that can be adapted to a facility for processing the outer surfaces of rolls, to plate outer surfaces of rolls, to effect pre-treatment or after-treatment for plating, or to effect buffing. More specifically, the invention relates to an improved apparatus for automatically attaching and detaching cassette-type rolls, which is separate from a line facility having a plurality of required processing devices or from conveyer means hanged from the ceiling of the line, but which is hanged from the conveyer means, and which is conveyed to required processing devices in the line facility, such that the rolls with both ends being chucked can be subjected to the required processings in the processing devices.

2. Prior Art

The inventors of the present application have conducted keen study in the field of photoengraving art related to photogravure rolls in order to realize a photogravure robot. Namely, the inventors have developed an apparatus for automatically attaching and detaching cassette-type rolls, which is separate from a line facility that has a plurality of required processing devices or from conveyer means hanged from the ceiling of the line, but which holds the rolls at both ends permitting them to rotate and permitting the flow of electric current, and which also seals the portions where the rolls are held. Using the thus developed apparatus, the inventors have developed a method of plating outer peripheral surfaces of the rolls, by holding the rolls in the form of a cassette that can be conveyed, conveying the cassette to a required device by conveyer means, subjecting the roll to a predetermined processing by rotating it in the device, conveying the roll to any other processing device to subject it to another processing in the same manner as mentioned above, and finally disassembling the cassette.

FIG. 1 shows the above-mentioned apparatus for automatically attaching and detaching cessette-type rolls.

The apparatus X for automatically attaching and detaching cassette-type rolls consists of a hanging frame 1, a pair of rotatable spindles 2, 3 which are opposed to each other at both ends of the hanging frame 1, a pair of current-carrying supporters 4, 5 which are provided at the ends of the spindles 2, 3, which support the roll R between the spindles, and which permit flow of electric current, a pair of leak-proof caps 6, 7 which are annularly provided on the outer side of the current-carrying supporters 4, 5, and which come into contact with end surfaces of the hollow roll to prevent the processing liquid from entering thereinto, an air cylinder unit 8 which is mounted on the hanging frame 1 to move the spindles 2, 3 at least in the axial directions, air cylinder chambers 9, 10 which are formed between the spindles and the leak-proof caps, and which drive the leak-proof caps 6, 7 toward the end surface of the roll being powered by the compressed air, and a compressed air supply means 11 which has a compressed air tank 11*a* and which supplies the compressed air to the air cylinder unit 8 and to the air cylinder chambers 9, 10.

The hanging frame 1 consists of a pair of side frames 1*a*, 1*a* which are provided at both ends of the frame in an opposing manner, and which are placed on processing devices of the line facility, and coupling frame 1*b* for coupling the pair of side frames. The coupling frame is made of a cylindrical member, and has a compressed air supply port to also serve as the compressed air tank 11*a*. The spindle 3 on the right side of FIG. 1 is equipped with a sprocket 14.

The operation will be described below briefly.

The apparatus X for automatically attaching and detaching cassette-type rolls, is placed on a roll R that is to be treated and that is placed on a roll attaching-/detaching plate which is not shown. The roll is moved rightwardly so that a tapered hole at the right end of the roll is fitted to the current-carrying supporter 5 located on the right.

The lever of a switch valve 12 is moved from a position (b) to a position (a), to supply the compressed air in the compressed air tank 11*a* into a cylinder chamber in the bottom of the air cylinder unit 8, whereby a piston 8*a* is pushed, and the current-carrying supporter 4 at the end of the left spindle 2 is fitted to a tapered hole formed in the left end of the roll R.

Then, the lever of a switch valve 13 is moved from a position (d) to a position (c), to supply the compressed air in the compressed air tank 11*a* to the right and left air cylinder chambers 10, 9, whereby the right and left leak-proof caps 7, 6 are brought into contact with end surfaces of the rolls R to prevent the processing liquid from entering.

Thus, the roll is chucked. The roll in the form of cassette is then placed on the right and left frames 41, 40 of a predetermined processing device Y in the line facility as shown in FIG. 2.

Then, four leak-proof plates 42*a*, 42*b*, 42*c*, 42*d*, each being split into two toward the right and left, work to close the leak-proof caps 6, 7 to prevent the leakage of liquid. Further, the sprocket 14 engages with a chain of a chain transmission device or with a gear of a gear device, which is not diagramed, so that the right spindle 3 is driven by a motor 43.

Then, if the motor 43 and a circulation pump 44 in the processing device Y are energized, the roll R supported by the right and left spindles 3, 2 spins and is immersed in the processing liquid in a processing vessel S, so that a predetermined processing is effected (plating, pre-treatment or after-treatment). When the electroplating is to be effected, an electric current is supplied to the roll R via the right and left spindles and the current-carrying supporters 4, 5.

The roll is then conveyed to another processing device in the line facility and is subjected to a predetermined processing.

To take out the roll R after all processings have been finished, the apparatus for automatically attaching and detaching the cassette-type rolls is conveyed to the attaching/detaching plate by a conveyer which is not shown, but which is hanged from the ceiling of the line. The switch valve 13 is then returned to the initial position (d) to release the compressed air in the air cylinder chambers 9, 10 into the open air, whereby the leak-proof caps 6, 7 are separated from the end surfaces of the roll.

The switch valve 12 is then returned to the initial position (b), the compressed air in the compressed air tank 11*a* is supplied into the cylinder chamber on the head side of the air cylinder unit 8, to retract the piston 8*a*. The left current-carrying supporter 4 is then separated away from the roll R.

If pushed leftwards by hand in FIG. 2, the roll R can be taken out.

The above-mentioned conventional apparatus for automatically attaching and detaching cassette-type rolls, can be adapted to hollow rolls R only. Therefore, it has been urged to modify the apparatus so that it can also be adapted to rolls with shaft.

In order to adapt the apparatus to the rolls with shaft, it can be contrived to employ the current-carrying supporters 4, 5 formed in a cylindrical shape, and to employ the leak-proof caps 6, 7 of an elongated form to increase the stroke. The photoengraving rolls, however, have a variety of lengths in the roll surface, a variety of roll diameters, and various sizes, lengths and shapes in the shaft portion. Therefore, the above-mentioned contivance is not sufficient to cope with variously changing sizes and lengths of the shaft portion.

SUMMARY OF THE INVENTION

The present invention was contrived in view of the above-mentioned respects, and provides an apparatus for automatically attaching and detaching cassette-type rolls, in which the current-carrying supporters are exchanged depending upon the types of the rolls to be processed, the leak-proof caps are made up of moving caps which slide on the outer side of the spindles and exchange caps which are fitted to outer periphery of shafts of the roll, and which are pressed onto the moving caps to press end surfaces of the roll, wherein the current-carrying supporters and the exchange caps are suitably selected so as to be adapted to the roll having shaft of any size, length or shape.

DESCRIPTION OF A PREFERRED EMBODIMENT

Figure 1:
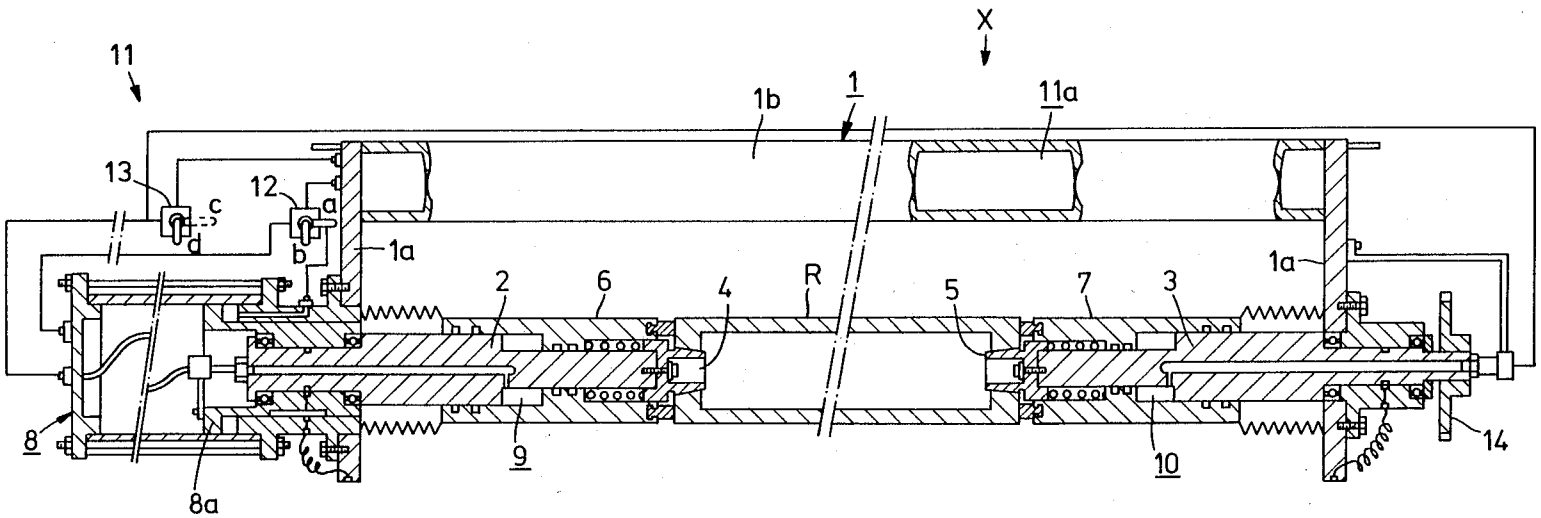
FIG. 1 is a sectional front view of a conventional apparatus for automatically attaching and detaching cassette-type rolls.
Figure 2:
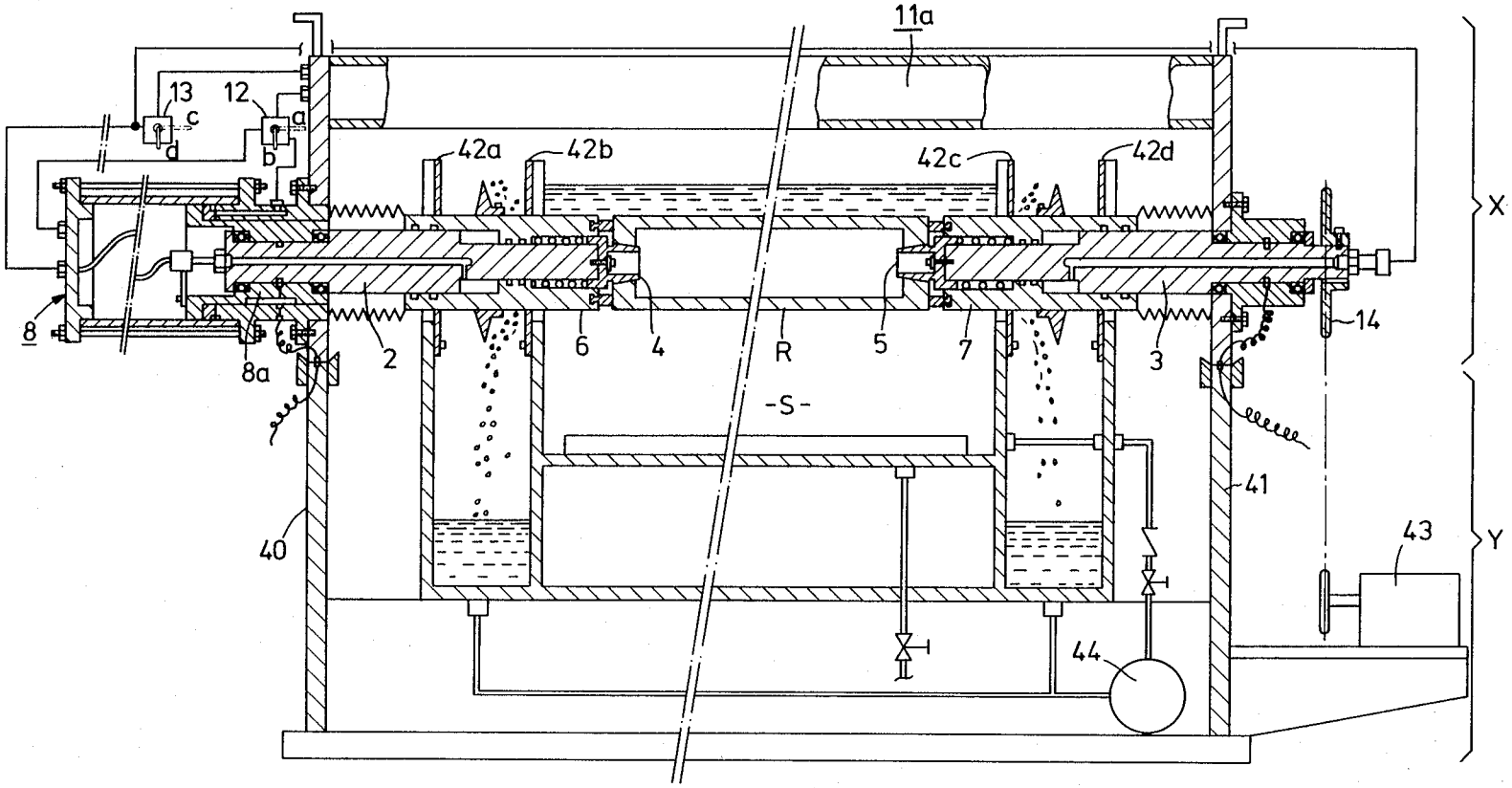
FIG. 2 is a sectional front view illustrating the state where a predetermined processing is effected by placing the conventional apparatus for automatically attaching and detaching cassette-type rolls on a required processing device.

The present invention deals with an apparatus for automatically attaching and detaching cassette-type rolls, comprising:

a hanging frame;

a pair of rotatable spindles which are provided in an opposing manner on both sides of the hanging frame;

a pair of current-carrying supporters which are provided at the ends of the spindles to support a roll that is to be treated between the spindles, said current-carrying supporters being capable of flowing electric current;

a pair of leak-proof caps which are annularly provided on the outer side of the current-carrying supporters, and which so move as to come into contact with the end surfaces of the roll to prevent the processing liquid from entering into the side of the current-carrying supporters;

an air cylinder unit which is mounted on the hanging frame and which moves at least one of said spindles in the axial directions;

air cylinder chambers which are formed between said spindles and said leak-proof caps, and which drive, by the compressed air, the leak-proof caps to come into contact with the end surfaces of said roll; and compressed air supply means which has a compressed air tank to supply the compressed air to said air cylinder unit and to said air cylinder chambers;

the improvement wherein said current-carrying supporters are selected and exchanged depending upon the type of the roll, and possess shaft-engaging portions which engage with and support the shaft portion of said roll, and spindle-engaging portions which are engaged with and supported by said spindles; and said leak-proof caps consist of moving caps that are fitted to the outer side of said spindles and that are moved by the compressed air supplied to said air cylinder chambers, and exchange caps that are selected depending upon the type of the roll, and that maintain air-tightness around the periphery of said spindles between the moving caps and the end surfaces of the roll when the roll is to be chucked.

The hanging frame should be composed of a pair of side frames that are provided at both ends in an opposing manner and that are placed on a line facility, and a coupling frame which also serves as a compressed air tank for the compressed air supply means, and which couples said pair of side frames as a unitary structure.

Two compressed air tanks may be provided, one for the air cylinder unit and another for the air cylinder chambers.

The current-carrying supporters are selected depending upon the type of the roll to be treated and are fitted to the shaft portion of the roll. The current-carrying supporters have spindle-engaging portions that will engage with the spindles. That is, the spindle-engaging portions are secured to the spindles by bolts, or are screwed into the spindles, or are coupled with the spindles through a spline, or are simply fitted to the spindles.

The current-carrying supporters further have shaft-engaging portions that engage with the shaft portion of the roll. The shaft-engaging portions are engaged with the shaft portion of the roll and are then engaged with the spindles. Or the shaft-engaging portions engage with the shaft portion of the roll after the spindle-engaging portions have engaged with the spindles.

The current-carrying supporters should be mounted being engaged with the support members which are provided at the ends of the spindles.

The leak-proof caps consist of moving caps and exchange caps. Outer surfaces of the caps must be made of an electrically nonconductive material. Further, the caps should be made of a heat-resistant plastic material in a cylindrical shape, and should have a sealing member at the ends close to the end surface of the roll.

The exchange caps should have shaft-engaging portions so that they are stably supported by the shaft portion of the roll to be treated, or should have additional engaging portions so as to be supported by the moving caps.

The exchange caps having additional engaging portions are so mounted as to be added to the moving caps.

Or the exchange caps are engaged with the shaft portion of the roll when they have shaft-engaging portions.

End surfaces of the moving caps and the exchange caps are brought into contact with each other to air-tightly maintain the interior thereof. Or the interior is air-tightly maintained by the tapered fitting, or by using a seal packing. No limitation, however, is imposed on the method of maintaining air-tightness.

Usually, a single exchange cap will suffice for the need. However, in case the roll to be treated has a long shaft portion, or the shaft has a distinctly stepped portion, a single exchange cap may not be sufficient for being stably mounted on the periphery of the shaft. Or in case the inner surface of the exchange cap is stepped, and requires an increased machining cost, two or more exchange caps may be provided.

When two or more exchange caps are used, each cap should be butted in series in the axial direction to maintain air-tightness in the interior.

The exchange cap should have a cylindrical shape which can be stably mounted on the outer periphery of the roll to be treated, and should be butted to the moving cap to accomplish the sealing.

Figure 3:
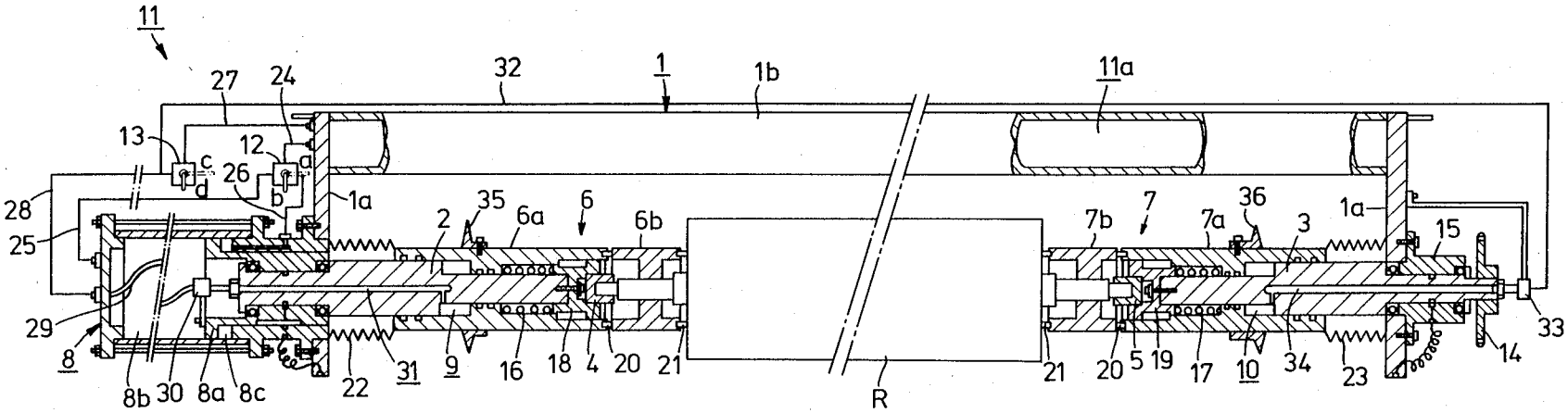
FIG. 3 is a sectional front view of an apparatus for automatically attaching and detaching cassette-type rolls according to an embodiment of the present invention.

FIG. 3 is a front view of an apparatus for automatically attaching and detaching cassette-type rolls according to an embodiment of the present invention.

This apparatus for automatically attaching and detaching cassette-type rolls comprises a pair of spindles 2, 3 provided in an opposing manner at both ends of a gate-shaped hanging frame 1, current-carrying supporters 4, 5 which are selectively exchanged at the ends of the spindles 2, 3 depending upon the type of roll, leak-proof caps 6, 7 around the periphery of the spindles and current-carrying supporters, the leak-proof caps 6, 7 being composed of movable caps 6*a*, 7*a* and exchange caps 6*b*, 7*b*, and compressed air supply means 11 with a compressed air tank 11*a*. The compressed air is supplied to the air cylinder unit 8 and to the air cylinder chambers 9, 10 to drive the spindle 2 in the axial direction. Further, the moving caps 6*a*, 7*a* are moved toward the direction of end surface of the roll to press the exchange caps 6*b*, 7*b* which are fitted to the shaft portion of the roll that is to be treated. Thus, interior of the caps is maintained air-tightly, and the roll is chucked at both ends.

The hanging frame 1 consists of a pair of side frames 1*a*, 1*a* that are provided in an opposing manner at both ends and that are placed on a required processing device in the line facility, and a coupling frame 1*b* which couples the pair of side frames together. The coupling frame 1*b* consists of a cylindrical member and has a compressed air supply port, which is not shown, to also work as a compressed air tank 11*a*.

The pair of spindles 2, 3 are made of an electrically conductive material, provided on the pair of side frames 1*a*, 1*a*, opposed to each other on a horizontal line, and slide relative to power-feed brushes which are provided on the side of the line facility to be served with the electric power. The spindle 2 on the left side in the drawing is rotatably supported by the cylindrical piston 8*a* made of an electrically nonconductive material in the air cylinder unit 8 which is secured at the lower end of the side frame 1*a* of the hanging frame 1 on the left side in the drawing. Therefore, the spindle 2 is allowed to spin and to move in the axial direction. The spindle 3 on the right side of the drawing is supported by a cylindrical bearing box 15 which is provided at the lower end of the side frame 1*a* on the right side. When the spindle 3 is to be placed on the line facility, the sprocket 14 provided at one end engages with a drive device (not shown) of the line facility, so that the spindle 3 is rotated.

The air cylinder chamber 9 is formed between a stepped portion of the spindle 2 and a stepped portion in the inner surface of the leak-proof cap. Further, the air cylinder chamber 10 is formed between a stepped portion of the spindle 3 and a stepped portion in the inner surface of the leak-proof cap 7. The leak-proof caps 6, 7 are brought into contact with the end surfaces of the roll by the compressed air which is supplied into the air cylinder chambers 9, 10. The pressure in the compressed air tank 11*a* is detected by a pressure gauge which is not shown. Springs 16, 17 are fitted between the leak-proof caps 6, 7 and the corresponding small-diameter portions of the spindles 2, 3 to return the leak-proof caps 6, 7.

The pair of current-carrying supporters 4, 5 are made of an electrically conductive material, fitted to the support members provided at the ends of the spindles 2, 3 in the axial direction, and work to support the roll therebetween and to flow the electric current. According to this embodiment, the current-carrying supporters 4, 5 are selected and exchanged depending upon the size of the shaft portion of the roll R. The supporters 4, 5 are engaged with the spindles 2, 3 when the roll is to be chucked, and are fitted to the shaft portion of the roll R prior to chucking the roll.

Support members 18, 19 are attached to the ends of the spindles 2, 3 to support the current-carrying supporters 4, 5.

The pair of leak-proof caps 6, 7 consist of moving caps 6*a*, 7*a* and exchange caps 6*b*, 7*b*.

The moving caps 6*a*, 7*a* are slidably fitted to the outer side of the spindles 2, 3 so as to be driven by the compressed air which is supplied into the air cylinder chambers 9, 10, and have a ring-like sealing member 20 made of rubber at the ends close to the roll to produce sealing function.

The exchange caps 6*b*, 7*b* are annular parts which are separate from the moving caps 6*a*, 7*a*, and are selectively exchanged depending upon the type of roll R that is to be treated.

The exchange caps 6*b*, 7*b* further assume a cylindrical shape and are stably fitted to the shaft portion of the roll R that is to be treated.

The exchange caps 6*b*, 7*b* have a ring-like sealing member 21 made of rubber at the ends close to the roll to produce sealing function.

When the compressed air is supplied to the air cylinder chambers 9, 10, therefore, end surfaces of the exchange caps 6*b*, 7*b* are pressed by the moving caps 6*a*, 7*a* which move outwardly of the current-carrying supports 4, 5. Therefore, the exchange caps 6*b*, 7*b* come into contact with end surfaces of the roll to maintain sealed condition; i.e., the processing liquid is prevented from entering into the side of the current-carrying supporters 4, 5 during the step of processing.

Bellows cylinders 22, 23 are provided between the leak-proof caps 6, 7 and the side frames 1*a*, 1*a* to cover the spindles 2, 3.

The compressed air supply means 11 works to supply the compressed air stored in the compressed air tank 11*a* to the air cylinder unit 8 and to the air cylinder chambers 9, 10.

That is, when the lever of switch valve 12 is at the position (a), the compressed air in the compressed air tank 11 is introduced into the cylinder chamber 8*b* in the bottom of the air cylinder unit 8 via switch valve 12 and pipe 25.

When the lever of switch valve 12 is at the position (b), the compressed air is introduced into the cylinder chamber 8*c* in the head portion via pipe 26, whereby the cylinder chamber 8*b* in the bottom portion is communicated with a port of the switch valve 12 on the side of the open air.

Further, when the lever of switch valve 13 is located at the position (c), the compressed air is introduced into the left air cylinder chamber 9 via pipe 27, switch valve 13, pipe 28, flexible pipe 29 which runs through the air cylinder unit 8, rotary joint pipe 30, and air-feed hole 31 formed in the spindle 2, and is further introduced into the right air cylinder chamber 10 via pipe 32, rotary joint pipe 33 and air-feed hole 34 formed in the spindle 3.

When the lever of switch valve 13 is at the position (d), the air cylinder chambers 9, 10 are communicated with a port of the switch valve 13 on the side of the open air.

By manipulating the switch valve 12, therefore, the air cylinder unit 8 can be driven to extend or retract the piston 8*a*. By manipulating the switch valve 13, furthermore, the leak-proof caps 6, 7 can be actuated.

Flange-like drain boards 35, 36 are provided at positions corresponding to an over-flow vessel of the line facility on the outer side of the leak-proof caps 6, 7.

The operation will be described below. The apparatus X for automatically attaching and detaching cassette-type rolls, is placed on the roll R that is to be treated and that is placed on the roll attaching/detaching plate (not shown) to chuck the roll. Here, however, the exchange caps 6*b*, 7*b* and the current-carrying supporters 4, 5 are fitted to the shaft portion of the roll R in advance. The current-carrying supporters 4, 5 must be so selected as to have an inner surface that fits to the shaft portion of the roll R.

Thereafter, the apparatus X for automatically attaching and detaching cassette-type rolls is placed on the roll R that is to be treated and that is placed on the roll attaching/detaching plate (not shown). The roll is then moved rightwards in the drawing. The current-carrying supporters 4, 5 fitted to the shaft portion at the right end of the roll are then fitted to support members at the ends of the spindles 2, 3. Thus, one end of the roll is engaged.

The lever of switch valve 12 is then shifted from the position (b) to the position (a) to introduce the compressed air in the compressed air tank 11*a* into the cylinder chamber in the bottom of the air cylinder unit 8 via pipe 24, switch valve 12 and pipe 25, to push out the piston 8*a*. The support member 18 at the end of the spindle 2 then engages with the current-carrying supporter 4 fitted to the end of the shaft portion on the left of the roll. Thus, both ends of the roll are chucked.

The roll R to be treated is sandwitched in the axial direction by the current-carrying supporters 4, 5. Therefore, a heavy current is allowed to flow into the roll.

Thereafter, if the lever of switch valve 13 is shifted from the position (d) to the position (c), the compressed air in the compressed air tank 11*a* flows into the right and left air cylinder chambers 10, 9, whereby the right and left moving caps 7*a*, 6*a* are urged to move toward the end surfaces of the roll R overcoming the force of the springs 16, 17. Sealing members 20 of the moving caps 6*a*, 7*a* push the exchange caps 6*b*, 7*b* fitted to the shaft portions of the roll R. Further, sealing members 21 of the exchange caps 6*b*, 7*b* are pressed onto the end surfaces of the roll R that is to be treated. Namely, the processing liquid is prevented from entering into the exchange caps 6*b*, 7*b*, the roll is chucked, and the cassette operation is completed.

Thereafter, the cassette is conveyed by a conveyer means (not shown) hanged from the ceiling of the line to a processing device in the line facility to perform a required processing.

To remove the roll R after all of the processing steps have been finished, the apparatus X for automatically attaching and detaching cassette-type rolls is placed on the attaching/detaching plate, and the lever of switch valve 13 is returned to the position (d). The compressed air in the air cylinder chambers 9, 10 then escapes into the open air through the switch valve 13, and the moving caps 6*a*, 7*a* separate away from the exchange caps 6*b*, 7*b* and return to the initial positions being urged by the springs 16, 17.

Then, if the lever of switch valve 12 is returned to the position (b), the compressed air in the compressed air tank 11*a* is supplied into the cylinder chamber 8*c* in the head portion of the air cylinder unit 8 and, at the same time, the compressed air in the cylinder chamber 8*b* in the bottom portion is allowed to escape into the open air through the switch valve 12. Accordingly, the piston 8*a* retracts, and the spindle 2 separates away from the current-carrying supporter 4.

If the roll R is pushed by hand toward the left in the drawing, the spindle 3 separates away from the current-carrying supporter 5, whereby the roll is liberated. The apparatus X for automatically attaching and detaching cassette-type rolls is then hanged up, and the current-carrying supporters 4, 5 and exchange caps 6*b*, 7*b* are removed from the shaft portions of the roll R.

When the roll with shaft of a different type is to be treated, the current-carrying supporters 4, 5 and exchange caps 6*b*, 7*b* are selected to suit for the roll.

Or, the current-carrying supporters 4, 5 may not be fitted to shaft portions at both ends of the roll, but may be fitted to the support members provided at the ends of the spindles 2, 3.

EFFECTS OF THE INVENTION

According to the apparatus for automatically attaching and detaching cassette-type rolls of the present invention as explained in the foregoing, at least one of the pair of spindles provided at both ends of the hanging frame in an opposing manner, is moved in the axial direction by the air cylinder unit which is driven by the compressed air supply means which has a compressed air tank. Further, the current-carrying supporters provided at the ends of the spindles can be selected and exchanged depending upon the type of roll. The leak-proof caps fitted to the circumference of the spindles and the current-carrying supporters to maintain the interior thereof air-tight, are made up of moving caps and exchange caps. The moving caps form air cylinder chambers relative to the spindles and, hence, move toward the end surfaces of the roll when the compressed air is introduced into the air cylinder chambers from the compressed air tank. Further, the exchange caps can be selected and exchanged depending upon the type of roll.

According to the present invention, therefore, the conventional apparatus can be so improved as to be adapted to the rolls with shaft in addition to the rolls of the sleeve type. Further, the improvement does not restrict the apparatus to be adapted to the rolls of one type only, but permits the apparatus to be adapted to the rolls of any types having shafts of different sizes and lengths.

That is, if the current-carrying supporters and exchange caps are prepared to suit for the rolls of all types, they can be exchanged depending upon the type of the roll; i.e., the apparatus can be adapted to the rolls having any lengths or having shafts of any shapes. Further, the current-carrying supporters and the exchange caps can be easily exchanged.

What is claimed is:

1. In an apparatus for automatically attaching and detaching cassette-type rolls having a shaft, comprising:

a hanging frame;

a pair of rotatable spindles which are provided in an opposing manner on both sides of the hanging frame;

a pair of current-carrying means which are provided at the ends of the spindles to support a roll that is to be treated between the spindles, said current-carrying means being capable of flowing electric current;

a pair of leak-proof cups which are annularly provided on the outer side of the current-carrying means, and which so move as to come into contact with the end surfaces of the roll to prevent the processing liquid from entering into the side of the current-carrying supporters;

an air cylinder unit which is mounted on the hanging frame and which moves at least one of said spindles in the axial directions;

air cylinder chambers which are formed between said spindles and said leak-proof caps, and which drive, by the compressed air, the leak-proof caps to come into contact with the end surfaces of said roll; and compressed air supply means which has a compressed air tank to supply the compressed air to said air cylinder unit and to said air cylinder chambers;

the improvement wherein;

said current-carrying means comprises replaceable current-carrying supporters which are selected depending upon the type of the roll and possess shaft-engaging portions which engage with and support the shaft portion of said roll, and spindle-engaging portions which are engaged with and supported by said spindles; and said leak-proof caps comprise moving caps fitted to the outer side of said spindles and moved by the compressed air supplied to said air cylinder chambers, and replaceable exchange caps which are selected depending upon the type of the roll and maintain airtightness around the periphery of said spindles between the moving caps and the end surfaces of the roll when the roll is to be chucked.

* * * * *